United States Patent [19]

Lord

[11] Patent Number: 4,741,371

[45] Date of Patent: May 3, 1988

[54] JIG FOR BENDING A HOCKEY STICK BLADE

[76] Inventor: Ghyslain C. Lord, 335, Parizeau Street, Boisbriand, Qc, Canada, J7G 2C6

[21] Appl. No.: 77,340

[22] Filed: Jul. 24, 1987

[51] Int. Cl.[4] ..... B27H 1/00

[52] U.S. Cl. ..... 144/269; 144/270; 144/381; 269/246; 269/265; 269/296

[58] Field of Search ..... 269/1, 243, 246, 265, 269/296, 909, 152; 144/2.12, 254, 259, 269, 270, 361, 380, 381

[56] References Cited

U.S. PATENT DOCUMENTS

| | | | |
|---|---|---|---|
| 2,848,785 | 8/1958 | Bachli et al. | 269/296 |
| 2,982,321 | 5/1961 | Hancock | 144/381 |
| 3,003,204 | 10/1961 | Bryant | 144/381 |
| 4,615,073 | 10/1986 | Haak | 269/1 |
| 4,691,907 | 9/1987 | Yang | 269/152 |

FOREIGN PATENT DOCUMENTS

| | | | |
|---|---|---|---|
| 3033802 | 8/1982 | Fed. Rep. of Germany | 144/381 |

*Primary Examiner*—W. Donald Bray

*Attorney, Agent, or Firm*—Roland L. Morneau

[57] ABSTRACT

A jig for bending a hockey stick blade is made of a backing plate and two spacers secured on one of its surface. The backing plate has two slots extending between the two spacers. A pressure plate located between the spacers is connected to the backing plate through the slots by a pair of threaded rods so as to slide along the slots. Tightening nuts are mounted on both rods. The hockey blade is adapted to abut on one side, at both end, against the spacers and on the other side of the blade, the pressure plate applies a pressure by tightening the nuts. The apex of the curve can be located anywhere along the blade and the plane of the face of the blade can also be tilted.

7 Claims, 2 Drawing Sheets

JIG FOR BENDING A HOCKEY STICK BLADE

BACKGROUND OF THE INVENTION

1. Field of the invention:

This invention relates to the bending of wood and more particularly to the bending of hockey stick blade according to a desired curvature.

Hockey players nowadays require hockey sticks with curved blades. The market supplies a very limited choice of curvature. The present invention provides a jig that will allow the hockey player to bend the blade of his hockey stick according to his ideosyncrasies and the desired trajectory of the hockey puck.

2. Prior art:

The bending of wood is an old art which probably varied according to the imagination of the artisans, the results expected and the pieces to be bent. A search has revealed Canadian Patent No. 81,108 directed to a holder for assisting in bending and in holding the same in bent condition until set. It is particularly directed to the formation of agee curve of shovel.

BRIEF SUMMARY OF THE INVENTION

The jig according to the invention, comprises a rigid backing plate provided with a pair of parallel tracks, a spacer secured to the plate at each end of the pair of tracks, a pressure plate slidably connected to the tracks, threaded rods, with nuts mounted between the tracks and the pressure plate for laterally moving the pressure plate and for changing the distance between the backing plate and the pressure plate. A hockey stick blade abutting against the spacers is bent by the pressure plate when the nuts are screwed on the threaded rods.

DETAILED DESCRIPTION OF THE INVENTION

Figure 3:
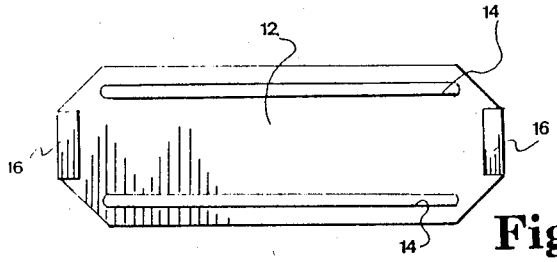
FIG. 3 is a front view of the backing plate of the jig shown in FIG. 1.
Figure 2:
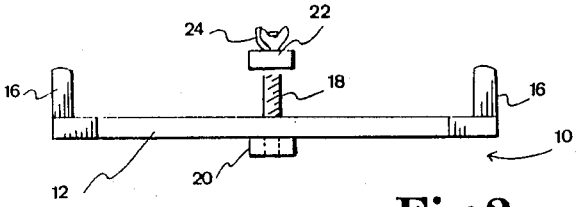
FIG. 2 is a top plan view of jig shown in FIG. 1.
Figure 1:
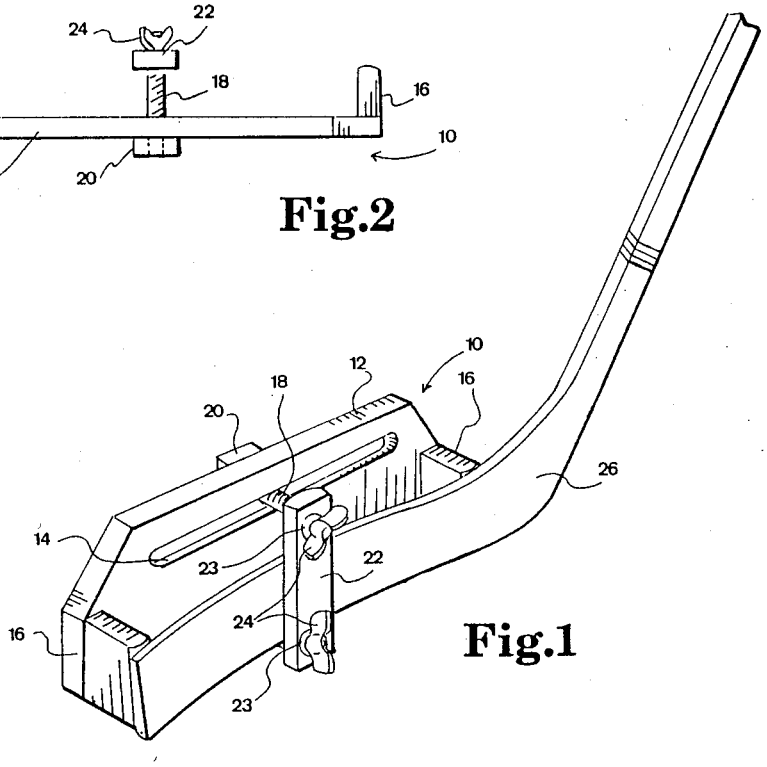
FIG. 1 is a perspective view of the jig according to the invention in which a hockey stick blade is inserted.

The jig 10 shown in FIGS. 1 and 2 comprises a substantially rectangular rigid backing plate 12 which is provided with a pair of elongated and parallel slots 14. A spacer 16 is secured at both ends of the plate 12. A pair of parallel slots 14 extends between the spacers 16 and are spaced by a distance exceeding the width of the hockey blades. The height of the spacers 16 exceeds the chord of the maximum arc expected for the curved blades. A threaded rod 18 slides through each slot 14. A block member 20 extends behind and across the backing plate 12 and more particularly across the two slots 14 and it retains the end of both threaded rods 18. The block member 20 is located on the face of the backing plate 12 opposite the spacers 16. A pressure plate 22 are provided with a pair of apertures 23 in which are slidably mounted the threaded rods 18. The pressure plate 22 is located on the side of the plate 12 opposite the block member 20 and is held on the threaded rods 18 by wing nuts 24.

The threaded rods 18 slide freely sideways in the slots 14 and simultaneously move with both the block member 20 and the pressure plate 22. The width of the slots 14 and the size of the apertures 23 exceeds the diameter of the threaded rods 18 to allow the pressure plate to be tilted sideways, forwards or backwards relative to its normal upright position. These additional movements of the pressure plate 22 increase the variety of curvatures to be exerted on the blade. The faces of the pressure plate 22 and of the spacers 16 coming in contact with the hockey blade are convex so that the blade is not marked by sharp edges.

The jig, according to the invention, can produce a curved blade with its apex at different places along its length because the pressure plate 22 can move sideways. The pressure plate can also be tilted relative to the blade for more personalized results. A hockey player who wishes to keep the puck close to the ice will be able to tilt the plane of the face of blade forward by tightening the lower wing nut 24 more than the upper one.

In operation, the hockey stick blade 26 is inserted between the spacers 16 and the pressure plate 22. One side of the blade 26 abuts at both ends, against the spacers 16. The pressure plate 22 is applied on the other side of the blade 26. The wing nuts 24 are turned until the desired curvature of the blade is reached. In order to obtain a permanent curvature, the blade is previously warmed by a heated element or with steam depending on the material of the blade. Considering that the jig is small and easy to manipulate, it may be used before or during a hockey game. A blade set under tension in the jig and left adjacent a lighted light bulb can protrude a satisfactory result.

The jig 10 is preferably made of wood. The backing plate 12 is a thick piece of wood which can resist bending and the spacers 16 must solidly secured to the plate 12 to counteract the leverage effect exerted by the blade. The pressure plate 22 and the block member 20 are also made of wood. It is obvious that these components could be made of steel or other rigid material.

Figure 4:
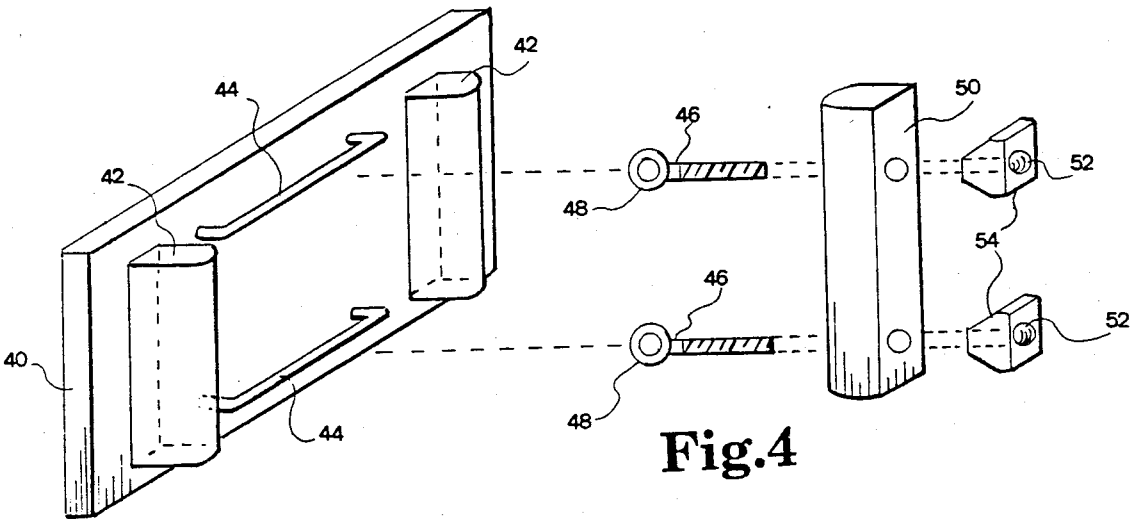
FIG. 4 is an exploded view of another embodiment of the invention.

Another embodiment is illustrated in FIG. 4. a backing plate 40 supports two spacers 42 and two guiding tracks 44 mounted between the spacers 42 in parallel relationship.

The guiding tracks are made of a steel rod and have an inverted U-shape. The upper surface of the spacers is convex. The threaded rods 46 are secured at one end to rings 48 adapted to slide on the tracks 44. The pressure plate 50 is provided with a pair of apertures 52 to freely receive the rods 46. The lower surface of the pressure plate 50 is convex.

The wing nuts 54 are mounted on the rods 46 to tighten the pressure plate 50 on the hockey blade. The size of the wing nuts 54 is preferably large to offer a good leverage. The sides of the nuts 54 flare out so that their rotation is not hindered by the hockey blade when the latter is substantially curved.

The spacers 42 and the pressure plates 50 have a convex surface in contact with the hockey blade to eliminate the sharp edges which could indent the surface of the hockey blade when the latter has been softened by heat or steam.

The spacer 42 located adjacent the tip of the blade may also be set at an angle relative to the backing plate 40 to provide an angle to the blade relative to the usual upright position. The angle of this spacer can be made adjustable if so desired.

I claim:

1. A jig for bending a hockey stick blade comprising a rigid backing plate, the said backing plate being provided with a pair of longitudinal guiding tracks on said backing plate, the said tracks being adjacent and substantially parallel to each other, spacer means fixed to said backing plate on one side thereof and at each end of said pair of tracks, a pressure plate located between said spacer means for connecting said tracks to said pressure plate for laterally moving said pressure plate and for adjustably spacing the said pressure plate relative to said backing plate, whereby a hockey stick blade abutting at both ends on said spacer means is adapted to be adjustably bent by said pressure plate.

2. A jig for bending a hockey stick blade comprising a rigid backing plate provided with a pair of spaced parallel slots, a spacer secured to said plate at each end of said pair of slots, a pressure plate mounted between said spacers and across said pair of slots, the pressure plate being adjustably spaced relative to the said spacers and to said backing plate, whereby a hockey stick blade applied against said spacers is adapted to be bent by adjustably moving said pressure plate relative to said backing plate.

3. A jig as recited in claim 2, comprising threaded rod means mounted through said slots and through said pressure plate for adjustably spacing the said pressure plate from the said backing plate.

4. A jig as recited in claim 3, comprising a block member mounted on the said plate member, on the side opposite the said pressure plate, the said threaded rod means passing through said block member for laterally moving substantially, in synchronism, with the said pressure plate.

5. A jig as recited in claim 4, whrein said threaded rod means comprises a pair of bolts mounted in substantially parallel relationship, each bolt freely passing through one of the slots and through the pressure plate and the block member, tightening means threadedly engaged on each of said bolts for applying pressure on said blade.

6. A jig as recited in claim 5, wherein the tightening means are wing nuts, the wing nuts being provided with a pair of wings extending away from said pressure plate.

7. A jig as recited in claim 2 wherein one of the spacers is set at an angle relative to the backing plate.

* * * * *